US005539205A

United States Patent [19]

Reale

[11] Patent Number: 5,539,205

[45] Date of Patent: Jul. 23, 1996

[54] CORONA GENERATING DEVICE AND METHOD OF FABRICATING

[75] Inventor: Louis Reale, Rochester, N.Y.

[73] Assignee: Xerox Corporation, Stamford, Conn.

[21] Appl. No.: 380,280

[22] Filed: Jan. 30, 1995

[51] Int. Cl.[6] ..... H01T 19/00

[52] U.S. Cl. ..... 250/326; 250/324; 355/221; 361/225; 430/937

[58] Field of Search ..... 250/326, 324, 250/325; 355/219, 221, 225; 361/225, 230; 430/935, 937

[56] References Cited

U.S. PATENT DOCUMENTS

| | | | |
|---|---|---|---|
| 2,836,725 | 5/1958 | Vyverberg | 250/49.5 |
| 4,086,650 | 4/1978 | Davis et al. | 361/229 |
| 4,265,990 | 5/1981 | Stolka et al. | 430/59 |
| 4,646,196 | 2/1987 | Reale | 361/230 |
| 4,920,266 | 4/1990 | Reale | 250/324 |
| 5,451,754 | 9/1995 | Reale | 250/324 |

*Primary Examiner*—Jack I. Berman

*Assistant Examiner*—Kiet T. Nguyen

*Attorney, Agent, or Firm*—Samuel E. Mott

[57] ABSTRACT

An element in a corona generating device having at least one conductive corona discharge electrode for depositing negative charge on an imaging surface in an electrostatographic imaging apparatus, the element being capable of adsorbing nitrogen oxide species generated when said corona generating device is energized and capable of desorbing nitrogen oxide species when the corona generating device is not energized, the element having an adhesion, promoting surface reclaimed from prior use in a similar capacity by immersion in an alkaline ultrasonic bath where the cavitation action of the bath is sufficient to remove any binder thereon and any metal, metallic compound and other solid particles as solid particles without metallic dissolution in the alkaline bath while at the same time providing a random microetched surface roughness to promote the subsequent coating and adherence of a substantially continuous thin conductive dry film of aluminum hydroxide containing graphite and powdered nickel, the reclaimed element having a substantially thin continuous conductive dry film of aluminum hydroxide containing graphite and powdered nickel.

19 Claims, 6 Drawing Sheets

CORONA GENERATING DEVICE AND METHOD OF FABRICATING

BACKGROUND OF THE INVENTION

The present invention relates generally to charging devices, and in particular, to charging devices which produce a negative corona. In my U.S. Pat. No. 4,920,266, I describe a corona generating device which is similar to the device described in the present application and which patent is hereby incorporated herein in it's entirety by reference. This device has proven to be very successful, but under certain applications to have a life span less than desired. In most applications it has a life span of between 500,000 prints and 1.2 million prints. The present application is directed to a rejuvenated device and a method for doing so that is environmentally safe, particularly since the powdered material particles, notably nickel are collected as a solid flake and are disposed of in an environmentally safe manner. By reclaiming or rejuvenating the device in the manner described herein, very substantial cost savings are achieved.

By way of background and introduction, the following disclosure from my U.S. Pat. No. 4,920,266 is repeated.

In an electrostatographic reproducing apparatus commonly used today, a photoconductive insulating member may be charged to a negative potential, thereafter exposed to a light image of an original document to be reproduced. The exposure discharges the photoconductive insulating surface in exposed or background areas and creates an electrostatic latent image on the member which corresponds to the image areas contained within the original document. Subsequently, the electrostatic latent image on the photoconductive insulating surface is made visible by developing the image with a developing powder referred to in the art as toner. During development the toner particles are attracted from the carrier particles by the charge pattern of the image areas on the photoconductive insulating area to form a powder image on the photoconductive area. This image may be subsequently transferred to a support surface such as copy paper to which it may be permanently affixed by heating or by the application of pressure. Following transfer of the toner image to the support surface the photoconductive insulating surface may be discharged and cleaned of residual toner to prepare for the next imaging cycle.

Various types of charging devices have been used to charge or precharge photoconductive insulating layers. In commercial use, for example, are various types of corona generating devices to which a high voltage of 5,000 to 8,000 volts may be applied to the control device thereby producing a corona spray which imparts electrostatic charge to the surface of the photoreceptor. One particular device would take the form of a single corona wire strung between insulating end blocks mounted on either end of a channel or shield. Another device, which is frequently used to provide more uniform charging and to prevent overcharging, is a scorotron which comprises one or more corona wires with a control grid or screen of parallel wires or apertures in a plate positioned between the corona wires and the photoconductor. A potential is applied to the control grid of the same polarity as the corona potential but with a much lower voltage, usually several hundred volts, which suppresses the electric field between the charge plate and the corona wires and markedly reduces the ion current flow to the photoreceptor.

A recently developed corona charging device is described in U.S. Pat. No. 4,086,650 to Davis et al., commonly referred to in the art as a dicorotron wherein the corona discharge electrode is coated with a relatively thick dielectric material such as glass so as to substantially prevent the flow of conduction current therethrough. The delivery of charge to the photoconductive surface is accomplished by means of a displacement current or capacitive coupling through the dielectric material. The flow of charge to the surface to be charged is regulated by means of a DC bias applied to the corona shield. In operation an AC potential of from about 5,000 to 7,000 volts at a frequency of about 4 KHz produces a true corona current, an ion current of 1 to 2 milliamps. This device has the advantage of providing a uniform negative charge to the photoreceptor. In addition, it is a relatively low maintenance charging device in that it is the least sensitive of the charging devices to contamination by dirt and therefore does not have to be repeatedly cleaned.

In the dicorotron device described above the dielectric coated corona discharge electrode is a coated wire supported between insulating end blocks and the device has a conductive auxiliary DC electrode positioned opposite to the imaging surface on which the charge is to be placed. In the conventional corona discharge device, the conductive corona electrode is also in the form of an elongated wire connected to a corona generating power supply and supported by end blocks with the wire being partially surrounded by a conductive shield which is usually electrically grounded. The surface to be charged is spaced from the wire on the side opposite the shield and is mounted on a conductive substrate.

In addition to the desirability to negatively charge one type of photoreceptor it often is desired to provide a negative precharge to another type of photoreceptor such as a selenium alloy prior to its being actually positively charged. A negative precharging is used to neutralize the positive charge remaining on the photoreceptor after transfer of the developed toner image to the copy sheet and cleaning to prepare the photoreceptor for the next copying cycle. Typically, in such a precharge corotron an AC potential of between 4,500 and 6,000 volts rms at 400 to 600 Hz may be applied. A typical conventional corona discharge device of this type is shown generally in U.S. Pat. No. 2,836,725 in which a conductive corona electrode in the form of an elongated wire is connected to a corona generating AC voltage.

Certain difficulties have been observed when using corona charge devices that produce a negative corona. It is believed that various nitrogen oxide species are produced by the corona and that these nitrogen oxide species are adsorbed by solid surfaces. In particular, it is believed that these oxide species are adsorbed by the conductive shield as well as the housing of the corona generating device. The shield may in principle be made from any conductor but is typically made from aluminum and the housing may be made from any of a number of structural plastics such as a glass filled polycarbonate. This adsorption of nitrogen oxide species occurs despite the fact that during operation the corona generating device may be provided with a directed air flow to remove the nitrogen oxide species as well as to remove ozone. In fact, during the process of collecting ozone the air flow may direct the nitrogen oxide species to an affected area of the charging device or even some other machine part. It has also been found that after such exposure, when a machine is turned off for extended periods of idleness, that the adsorbed nitrogen oxide species gradually are desorbed, that is the adsorption is a physically reversible process. It should be understood that the adsorbed and desorbed species are both nitrogenous but not necessarily the same, i.e., there may be conversion of $NO_2$ to $HNO_3$. Then, when the operation of the machine is resumed, a copy quality defect is observed in the copies produced in that a line image deletion or lower density image is formed across the width of the photoreceptor at that portion of its surface which was at rest opposite the corona generating device during the period of idleness. While the mechanism of the interaction of the desorbed nitrogen oxide species and the photoreceptor layers is not fully understood, it is believed that they in some way interact with the surface of the photoreceptor increasing the lateral conductivity so that it cannot retain a charge in image fashion to be subsequently developed with toner. This basically causes narrow line images to blur or to wash out and not be developed as a toner image. This defect has been observed with conventional selenium photoreceptors which generally comprise a conductive drum substrate having a thin layer of selenium or alloy thereof vacuum deposited on its surface as the imaging surface. The difficulty is also perceived in photoreceptor configuration of plates, flexible belts, and the like, which may include one or more photoconductive layers in the supporting substrate. The supporting substrate may be conductive or may be coated with a conductive layer over which photoconductive layers may be coated. Alternatively, the multilayered electroconductive imaging photoreceptor may comprise at least two electrically operative layers, a photogenerating layer or a charge generating layer and a charge transport layer which are typically applied to the conductive layer. For further details of such a layer, attention is directed to U.S. Pat. No. 4,265,990. In all these varying structures, several of the layers may be applied with a vacuum deposition technique for very thin layers.

Furthermore, with prolonged exposure of the photoreceptor to the desorbing nitrogen oxide species during extended periods of idleness the severity of the line defect or line spreading increases. While the mechanism is not fully understood it has been observed that even after a relatively short period of time, 15 minutes, and a period of idleness of, say, several hours, a mild line defect and concurrent image deletion may be perceived. During the initial stage of exposure of the photoreceptor to the desorbing nitrogen oxide species, it is possible to rejuvenate the photoreceptor by washing with alcohol since reaction between the photoreceptor and the nitrogen oxide species is purely at the surface. However, after a prolonged period of time the reaction tends to penetrate the photoreceptor layer and cannot be washed off with the solvent. Thus, for example, the problem is perceived after a machine has been operated for about 10,000 copies, rested overnight and when the operator activates the machine the following morning, the line deletion defect will appear. As indicated above the defect is reversible to some degree by a rest period. However, the period involved may be of the order of several days which to an operator is objectionable.

Similar difficulties are encountered in a precharge corotron with a negative DC potential applied. Attempts to solve that problem by nickel plating the corotron shield met with limited success in that nickel combined with the nitrogen oxide species forming a nickel nitrate which is a deliquescent salt and on continued use becomes moist with water from the air eventually accumulating sufficient water that droplets may form and drop off onto the photoreceptor. Furthermore, the nickel nitrate salts are green crystalline and loosely bonded rather than a cohesive durable film. In another attempt to solve a similar difficulty in a negative charging A.C. dicorotron device the shield is coated first with a layer of nickel that is subsequently plated with gold. However, as a result of the extreme expense of gold, the gold is plated in a very thin layer and consequently the layer is discontinuous having numerous pores in the layer. Gold plating is theorized to provide a relatively inert surface which will not adsorb the nitrogen oxide species or will not permit conversion to a damaging form. However, with the thin porous layer of gold, the nickel substrate underneath the gold corrodes forming nickel nitrates in the same manner as with the precharge corotron and experiences similar difficulties resulting in limited useful life.

PRIOR ART

In addition, my U.S. Pat. No. 4,646,196 also addresses the problem and provides a conductive dry film of aluminum hydroxide which may contain conductive particles such as graphite as a coating on the elements capable of absorbing and neutralizing the nitrogen oxide species. Electrodag 12 is disclosed as a coating. Further, my U.S. Pat. No. 4,920,266 describes a conductive dry film of aluminum hydroxide containing conductive particles of graphite and nickel.

By way of further background due to green forces, stricter environmental issues, many companies are looking to recycle, refurbish and reuse machine components that have either failed or reached an end of life condition. This is especially true in the case of a customer replaceable unit cartridge component which are relatively short lived. Ideally, re-working parts should be equal to or superior in quality, reliability to that of new parts. In addition, the reworking process should be reasonably safe, reproduceable, and a cost effective system.

Accordingly, efficient stripping of the conductive coating (nickel/carbon) from scorotron grids, for example, to enable recoating and reuse of the part, is a principle objective of the present invention. The overcoating loses it's effectiveness with machine operation as well as becoming contaminated and therefore must be removed prior to recoating of the grid. The grids are of a very awkward geometry possessing hard to reach areas such as inside wall surfaces or holes, corners or bent side shields, which present a challenge to a line of sight process such as grit blasting. In addition, with such a process one must deal with the complex safety concerns with airborne carbon, nickel particulates and the disposal of the contaminated grid.

SUMMARY OF THE INVENTION

In accordance with the present invention an element in the corona generating device having at least one conductive corona discharge electrode for depositing a negative charge on an imaging surface is provided, as well as a method for rejuvenating that element when it's operative life has expired by providing said element with an adhesion promoting surface reclaimed from prior use in the similar capacity by immersion in an alkaline ultrasonic bath where the cavitation action of the bath is sufficient to remove any binder and any metal, metallic compound and other solid particles as solid particles without metallic dissolution in the alkaline bath while at the same time providing a microetched surface roughness to promote the subsequent coating and adherence of a substantially continuous thin conductive dry film of aluminum hydroxide containing graphite and powdered nickel.

In accordance with a principle aspect of the present invention the ultrasonic bath is an aqueous alkaline cleaner/stripper.

In accordance with a principle aspect of the present invention the adhesion promoting surface of the element is formed by small pits randomly dispensed across the surface to provide an average pit depth and surface roughness which produces a dull like surface finish which promotes mechanical adhesion. Typically, the surface roughness to obtain satisfactory adhesion is from about 15 to $20\times10^{-6}$ inches and preferably about $18\times10^{-6}$ inches.

In accordance with a further aspect of the present invention the solid material on the element includes graphite and nickel which are removed in a flake condition, collected and disposed of as solid particles in an environmentally safe manner.

For a better understanding of the invention as well as other aspects and further features thereof, reference is had to the following drawings and descriptions.

DESCRIPTION OF THE PREFERRED EMBODIMENTS

Figure 1:
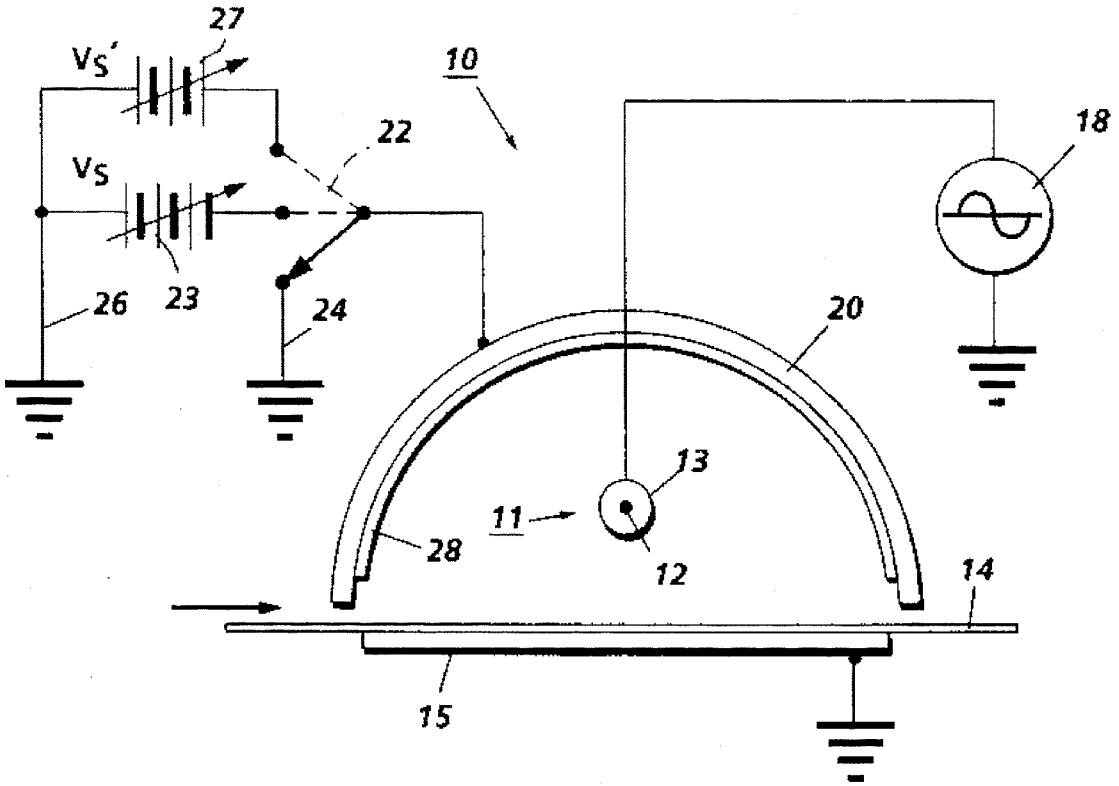
FIG. 1 is an illustrative cross section of a corona discharge device according to the present invention.

Referring to FIG. 1 the corona generator 10 of this invention is seen to comprise a corona discharge electrode 11 in the form of a conductive wire 12 having a relatively thick coating 13 of dielectric material.

A charge collecting surface 14 is shown which may be a photoconductive surface in a conventional xerographic systems. The charge collecting surface 14 is carried on a conductive substrate 15 held at a reference potential, usually machine ground. An AC voltage source 18 is connected between the substrate 15 and the corona wire 12, the magnitude of the AC source being selected to generate a corona discharge adjacent the wire 12. A conductive shield 20 is located adjacent the corona wire on the side of the wire opposite the chargeable surface.

The shield 20 has coupled thereto a switch 22 which depending on its position, permits the corona device to be operated in either a charge neutralizing mode or a charge deposition mode. With the switch 22 as shown, the shield 20 of the corona device is coupled to ground via a lead 24. In this position, no DC field is generated between the surface 14 and the shield 15 and the corona device operates to neutralize over a number of AC cycles any charge present on the surface 14.

With switch 22 in either of the positions shown by dotted lines, the shield is coupled to one terminal of a DC source 23 or 27, the other terminals of the sources being coupled by lead 26 to ground thereby establish a DC field between the surface 14 and the shield 20. In this position, the corona operates to deposit a net charge onto the surface 14, the polarity and magnitude of this charge depends on the polarity and magnitude of the DC bias applied to the shield 20.

The corona wire 13 may be supported in conventional fashion at the ends thereof by insulating end blocks (not shown) mounted within the ends of shield structure 20. The wire 12 may be made of any conventional conductive filament material such as stainless steel, gold, aluminum, copper, tungsten, platinum or the like. The diameter of the wire 11 is not critical and may vary typically between 0.5–15 mils and preferably is about 9 mils.

Any suitable dielectric material may be employed as the coating 13 which will not break down under the applied corona AC voltage, and which will withstand chemical attack under the conditions present in a corona device. Inorganic dielectrics have been found to perform more satisfactorily than organic dielectrics due to their higher voltage breakdown properties, and greater resistance to chemical reaction in the corona environment.

The thickness of the dielectric coating 13 used in the corona device of the invention is such that substantially no conduction current or DC charging current is permitted therethrough. Typically, the thickness is such that the combined wire and dielectric thickness falls in the range from 7–30 mil with typically dielectric thickness of 2–10 mil. Glasses with dielectric breakdown strengths above 2 KV/mil at 4 KHz and in the range of 2 to 5 mil thickness have been found by experiment to perform satisfactorily as the dielectric coating material. As the frequency or thickness go down the strength in volts per mil will usually increase. The glass coating selected should be free of voids and inclusions and make good contact with or wet the wire on which it is deposited. Other possible coatings are ceramic materials such as alumina, zirconia, boron nitride, beryllium oxide and silicon nitride. Organic dielectrics which are sufficiently stable in corona may also be used.

The frequency of the AC source 18 may be varied widely in the range from 60 Hz commercial source to several megahertz. The device has been operated and tested at 4 KHz and found to operate satisfactorily.

The shield 20 is shown as being semi-circular in shape but any of the conventional shapes used for corona shields in xerographic charging may be employed. In fact, the function of the shield 20 may be performed by any conductive member, for example, a bare wire, in the vicinity of the wire, the precise location not being critical in order to obtain satisfactory operation of the device.

With the switch 22 connected as shown, so that the shield 20 is grounded, the device operates to inherently neutralize any charge present on the surface 14. This is a result of the fact that no net DC charging current passes through the electrode 11 by virtue of the thick dielectric coating 13 and the wire 12.

Referring to FIG. 1, operation of the corona device of the invention to deposit a specific net charge on an imaging surface is accomplished by moving switch 22 to one of the positions shown in dotted lines, whereby a DC potential of either positive polarity or negative polarity with respect to the surface 15 may be applied to the shield.

In charging operation typical AC voltages applied to the corona electrodes are in the range from 4 KV to 7 KV at a frequency between 1 KHz and 10 KHz. With the conductive substrate of the imaging member being held at ground potential a negative DC bias of from about 800 volts to about 4 KV is applied to the shield. For further details of the manner of operation of the above described dicorotron device, attention is directed to U.S. Pat. No. 4,086,650 to Davis et al.

Referring once again to FIG. 1, the shield 20 is coated at least on its top with a substantially continuous thin conductive dry film 28 of aluminum hydroxide containing graphite particles and powdered nickel to neutralize the nitrogen oxide species that may be generated when a dicorotron is energized. Typically, the dry film is formed by drying or dehydrating a liquid dispersion; preferably aqueous, which has been applied as a somewhat gelatinous coating to the substrate shield. Typically, the graphite is present in the dispersion in an amount from about 7 percent to 13 percent by weight of the total weight of the dispersion. The graphite particles are typically from about 0.04 micrometers to about 22 micrometers in size. The powdered nickel is present in the dispersion in an amount of from about 3 percent to about 5 percent by weight of the total weight of the dispersion. Typically, the nickel powders have a particle size of from about 1.1 micrometers to about 34 micrometers. In addition, small quantities up to about 10% by weight of the total weight of the film of non-reactive filler such as silica may be present in the coating composition. It is believed that such nonreactive filler provides film resilience to the corona environment. Reactive conductive fillers such as metallic particles are not preferred since they tend to react with the nitrogen oxide species forming nitrate powders.

While such a composition is capable of performing satisfactorily it is preferred to include a binder in the coating composition to enhance the mechanical properties of the film such as its adhesion to the substrate to be coated and the cohesion of the dried film matrix. Typically, the binders are water soluble and dispersible resins which are present in amounts up to about 34 percent by weight of the total weight of the dry conductive film. Polyvinyl acetate is a typical such binder.

The substantially continuous thin conductive dry film of aluminum hydroxide containing graphite particles and powdered nickel may be formed on the surface to be coated by applying an aqueous solution or dispersion as a thin film thereto. Typically, the dry films can be formed by applying the coating dispersion by spraying, including electrostatic spraying, or brushing as with a paint or by dip coating. Upon drying which includes room and elevated temperature the liquid films dehydrate so as to provide a coherent film with a strong rigid adhesive bond to the surface to be coated. The dispersion is applied in a thickness that will not be consumed in a reasonable period of time by the irreversible neutralization of the nitrogen oxides. Typically, it is applied in a thickness to provide a dry film thickness of from about 0.3 to about 1.0 mil as a substantially uniform continuous layer without pores. The film may be applied in a single layer or in multiple layers as desired.

The exact mechanism by which the aluminum hydroxide film containing graphite and nickel provides long effective life in neutralizing the nitrogen oxides species without the formation and buildup of nitrate and carbonate salts is not fully understood. However, it is believed that the aluminum hydroxide combines with the nitrogen oxide species to form an aluminum nitrate in an irreversible reaction but no white powder is observed. Such a mechanism would completely remove the possibility of exposure of the photoreceptor to the nitrogen oxide species. Since no white powder is observed it is believed that the reaction may take place slowly on a molecular scale which is not perceived by the unaided eye with the reaction products remaining dispersed in the original film. Furthermore, the adherent film formed on drying is believed to exist as the unhydrated aluminum oxide, a hydrated oxide or aluminum hydroxide or mixtures thereof. One way of characterizing the action of the aluminum oxide-hydrated is as an aluminum hydroxide which in the presence of nitrogen oxides acts as a base according to the following net reaction:

$$Al(OH)_3+HNO_3 \rightarrow Al(OH)_2NO_3+H_2O$$

The nickel powder in the film also tends to neutralize the nitrogen oxide species, however, this occurs with substantially no salt formation. In this regard nickel powder is somewhat unique. The presence of the nickel powder also enhances the conductivity imparted to the film by the presence of the graphite particles.

Figure 2:
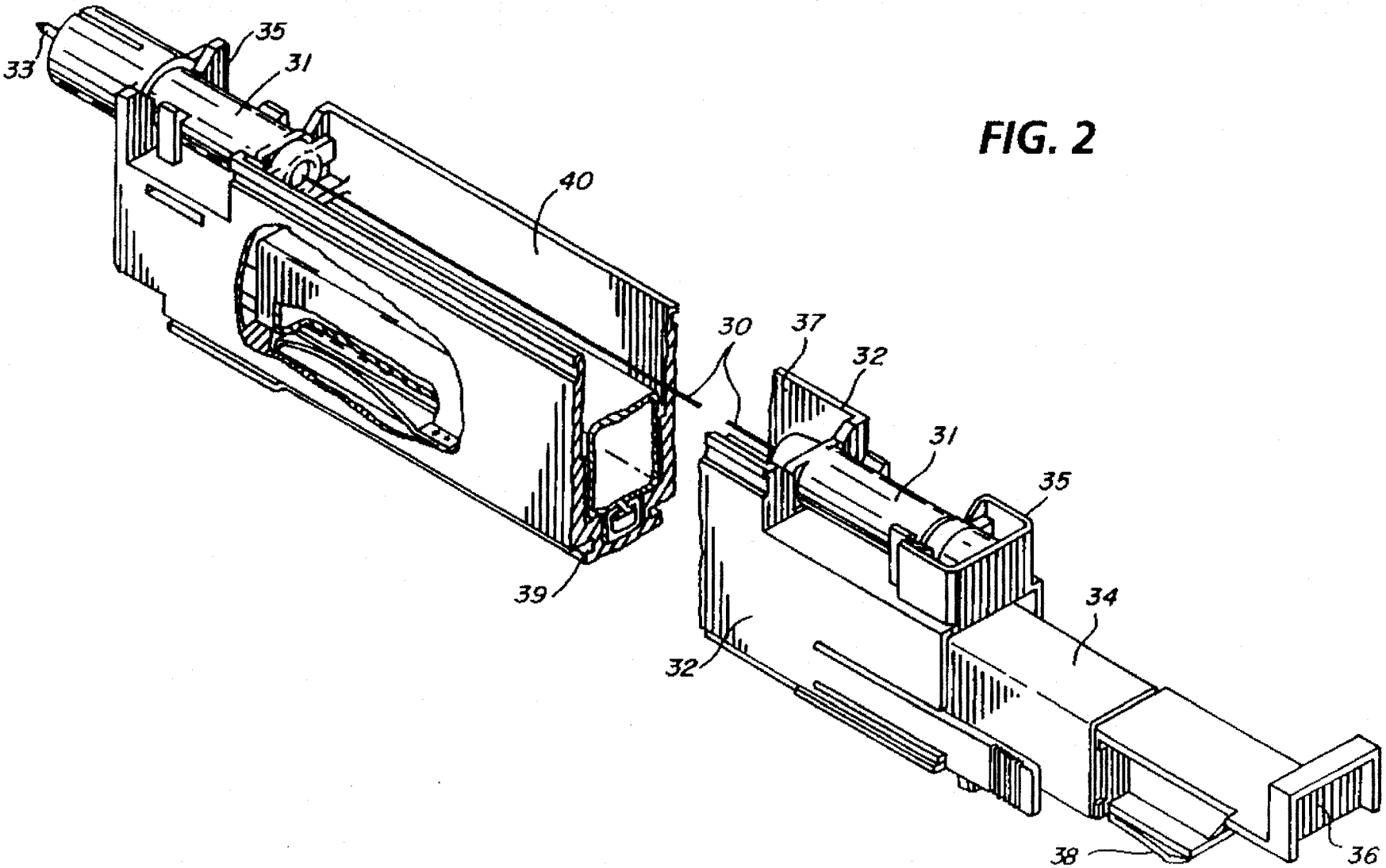
FIG. 2 is an isometric view of a preferred embodiment of a dicorotron according to the present invention.
Figure 3:
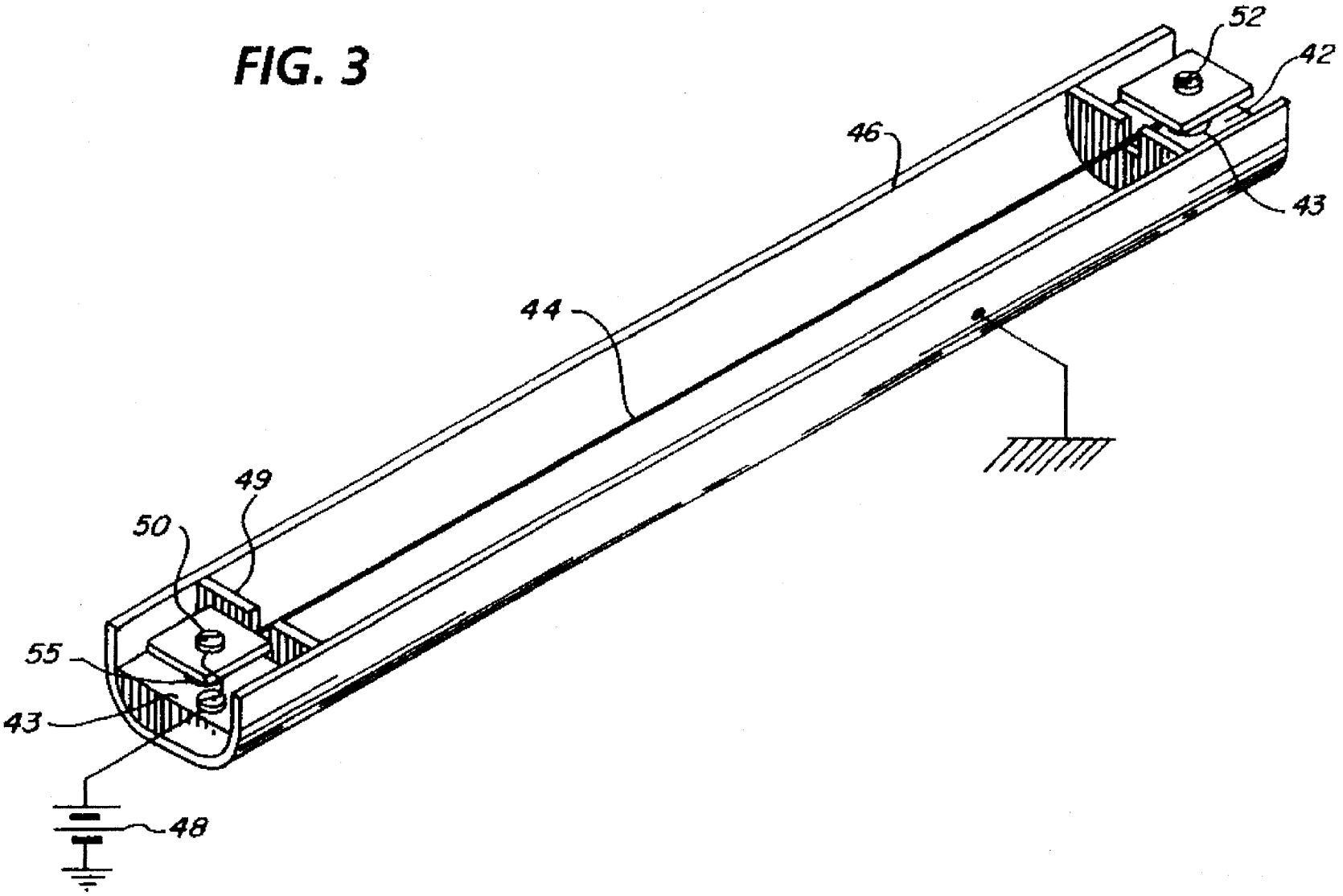
FIG. 3 is an isometric view of another preferred embodiment of a corotron according to the present invention.

FIG. 2 illustrates a preferred embodiment in the dicorotron device according to the present invention. In FIG. 2 the dicorotron wire 30 is supported between anchors 31 at opposite ends which are anchored in end blocks 35. The conductive shield 34 is constructed in tubular fashion in such a way as to be slideably mounted in the bottom of the housing 39 by means of handle 36. The shield is connected to the power supply through a sliding contact on its inner surface to a leaf spring which in turn is connected to a DC pin connector (not shown). The power supply potential may be positive, negative, or zero (grounded) depending on device function. It is fastened in place when inserted within the housing 39 by means of spring retaining member 38. When inserted in the machine high voltage contact pin 33 provides the necessary contact to the AC power supply. In addition to the conductive shield 34 the housing 39 comprises two vertically extending side panels 32 extending the entire length of the dicorotron wire. Both the top and inner surfaces of the shield 34 may have a substantially continuous thin conductive dry film of aluminum hydroxide containing graphite and nickel powder. In addition, the vertically extending panels 32 of the housing 39 may also be coated with a film 40 according to the present invention. The housing 39 together with the side panels 32 may be made form a single one piece molding from any suitable material such as glass filled polycarbonate.

Figure 4:
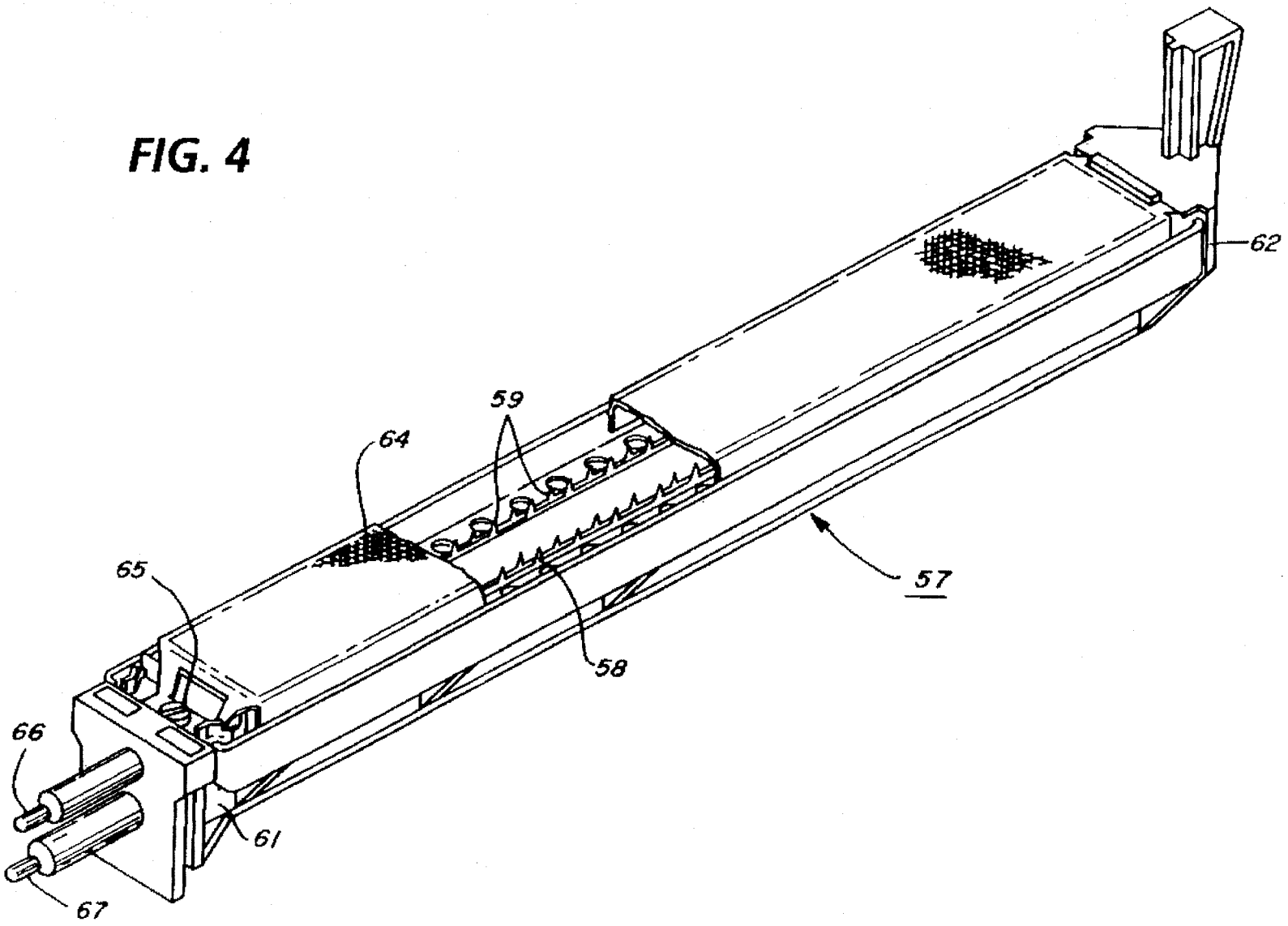
FIG. 4 is an isometric view of another preferred embodiment of a scorotron according to the present invention.
Figure 5:
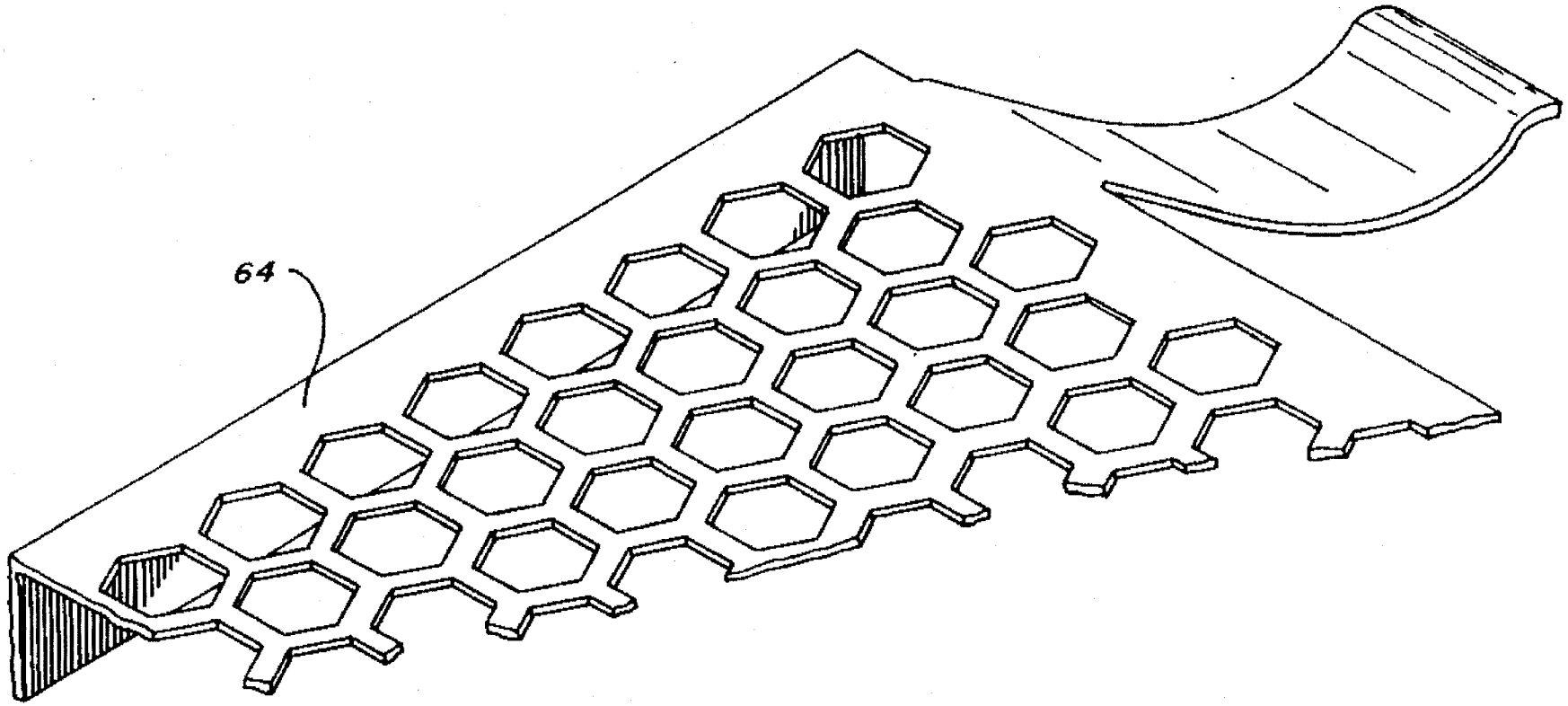
FIG. 5 is an enlarged view of the control grid used in the scorotron illustrated in FIG. 4.

FIGS. 4 and 5 illustrate alternative preferred embodiments according to the present invention which embody use of the present invention in coating the conductive corona control gird of a scorotron. In FIG. 4, scorotron 57 is represented as including two linear pin electrode arrays 58, and 59 supported between insulating end block assemblies 61 and 62. The conductive corona control grid 64 is placed on top of the linear pin arrays and anchored in place by means of screw 65 to potential generating source by lead 66. Both of the linear pin electrode arrays 58 and 59 are connected to potential generating source 67. Such a device might have utility as a negative charging corona generating device wherein the potential from a high voltage DC power supply applied to the grid is about −800 volts or very close to the voltage desired on the imaging surface which is closely spaced therefrom. The potential applied to the two linear pin electrode arrays is in the range of from about −6,000 to about −8,000 volts. The entire assembly is supported by being clamped between three injection molded plastic support strips. In this configuration the two linear pin coronodes in the shape of a saw tooth provide vertically directional fields and currents due to their geometry providing a higher efficiency of current to the photoconductor versus the total current generated. The grid acts as a leveling device or reference potential limiting the potential on the substrate being charged. In accordance with the present invention, the grid may be coated with a substantially continuous thin conductive dry film of aluminum hydroxide containing graphite and powdered nickel. In a preferred embodiment of the present invention the grid is fabricated from a beryllium copper alloy since it appears to reduce the effect of the nitrogen oxide species when compared to other metals such as stainless steel. Typically, beryllium is present in the alloy in an amount of from about 0.1% to about 2.0% by weight. A preferred alloy is Copper Development Associates 172 (CDA 172) which is 1.8% by weight beryllium. In a particularly preferred embodiment the pin electrodes are also made of the same beryllium copper alloys.

The efficiency of several different coatings was evaluated using a pin scorotron array and grid as illustrated in FIGS. 4 and 5 for both a grid made from stainless steel and one made from beryllium copper alloy.

In the tests, the scorotron screens or grids were driven in a test fixture at common voltage levels of −1000 volts. Voltage was applied to the coronode to produce a 2 milliamp corona current. Testing was performed in a high humidity environment, conducive to the production of deletions. The screen was spaced 0.118 in (3 mm). from a bare aluminum surface. The screens were coated with the selected coatings, as described. Periodically, about every 48 hours, the scorotrons were removed from the aging fixture, the pins cleaned, and the scorotrons inserted into a Xerox 1065 copier to produce copies for evaluation. The scorotrons were allowed to "outgas" or desorb nitrogen oxide species for 20 minutes. Several copies of a test pattern were made and the parking deletion level was scored by the following convention:

The functional performance as well as the failure mode of the rejuvenated part and the original part is the same as that described in the aforementioned U.S. Pat. No. 4,920,266, which results in print deletions as a result of the absorption of the coating by noxious nitrogen oxide species.

While the part may be reclaimed, rejuvenated through many different processes, it has been found to be most cost effective to use a liquid solvent bath which will provide the ability to reach all surfaces of a water-base type material which will mildly attack the binder system of the coating, producing a loosely adherent film on the part. The solvent or solvent selected should not possess the ability to dissolve or chemically react with either of the graphite or the nickel, thereby preserving it in it's solid state for environmental disposition. The loosely adherent film on the part may then be broken up into flakes and removed from the part by any suitable process, including brushing, boiling action, vibration of part, etc. The most effective process to perform this operation is by causing cavitation on the part surface which is essentially a boiling of solvent at a reduced temperature by utilizing high ultrasonic energy directed at the parts in the solvent bath. As the coating flakes fall from the part they're easily removed from the solvent bath by a filtration system. This process yields a lower temperature longer lived bath with a simple method to concentrate and contain the nickel/carbon solid waste, which once removed from a filter can be sold to a metal reclaim operation. The clean bare grid substrates after the appropriate rinse and dry stages can then be recoated.

Typically, the alkaline bath has a PH of about b 8.5and can range from about 7.5 to about 11 and the frequency of the ultrasonic bath can vary from about 20 to 40 KHz. The part to be cleaned is placed in the bath for a relatively short period of time of about 30 seconds to a minute and is totally cleaned in about 5 minutes. As previously stated, the solid material comes off the part as solid flakes is mechanically filtered, compressed, dried or dried and compressed and the hazardous components can be disposed of in solid form. This is in contrast to the typical cleaning and conventional acid bath such as nitric acid to remove such coatings where the hazardous material is dissolved in the stripper/cleaner which is much more difficult to be disposed of. Any suitable alkaline bath may be utilized in this process. A typical bath is that available from the Branson Ultrasonics Corporation of Danbury, Conn. wherein an aqueous stripping solution of 65% sodium hydroxide, 24% sodium silicate, 5% sodium carbonate, 5% sodium 23456 pinta hydroxy hexanoate and 1% methyl methylene sodium sulfonate is used. This provides a blend of free caustic alkaline salt silicates and wetting agents and has minimal effect on metals such as stainless steel, steel, copper or brass.

In addition to removing the previous coating the surface of the substrate is chemically cleaned of foreign deposits, roughened and etched to provide a surface roughness to promote the subsequent coating and adherence of a second conductive dry film of aluminum hydroxide containing graphite and powdered nickel. As discussed above, the ultrasonic bath is typically an aqueous alkaline cleaner/stripper and the adhesion promoting surface of the element is formed by small pits randomly dispersed across the surface to provide an average pit depth and surface roughness which produces a dull like surface finish which promotes mechanical adhesion. Typically, the surface roughness to obtain satisfactory adhesion is from about 15 to $20\times10^{-6}$ inches and preferably about $18\times10^{-6}$ inches which provides good mechanical adhesion for most coatings. While for a given metal or metal alloy pits due to the cavitation action can be generated with depths of over $500\times10^{-6}$ inches, the pit depth and thereby surface roughness can be controlled by regulating the operating parameters which include ultrasonic intensity and frequency, substrate exposure time to the bath action, solvent composition and temperature. While the pitting to form the microetched surface is preferably relatively uniform within the dimensional criteria previously set forth an occasional spike in the pit depth can be tolerated and may in fact promote an additional anchoring of the subsequently coated substrate. It is currently believed that the originally stripped substrate will work longer and more effectively because of the increased surface roughness and the increased adhesion of the coating to the substrate. Also the reused substrate receiving a second coating has better wetability than the first coating due to a lower surface energy of the substrate surface after treatment in the ultrasonic cleaning system when compared to the original substrate. The alkaline treatment of the substrate generates a more favorable surface for the deposition of alkaline thin films when compared to the original substrate.

Figure 6:
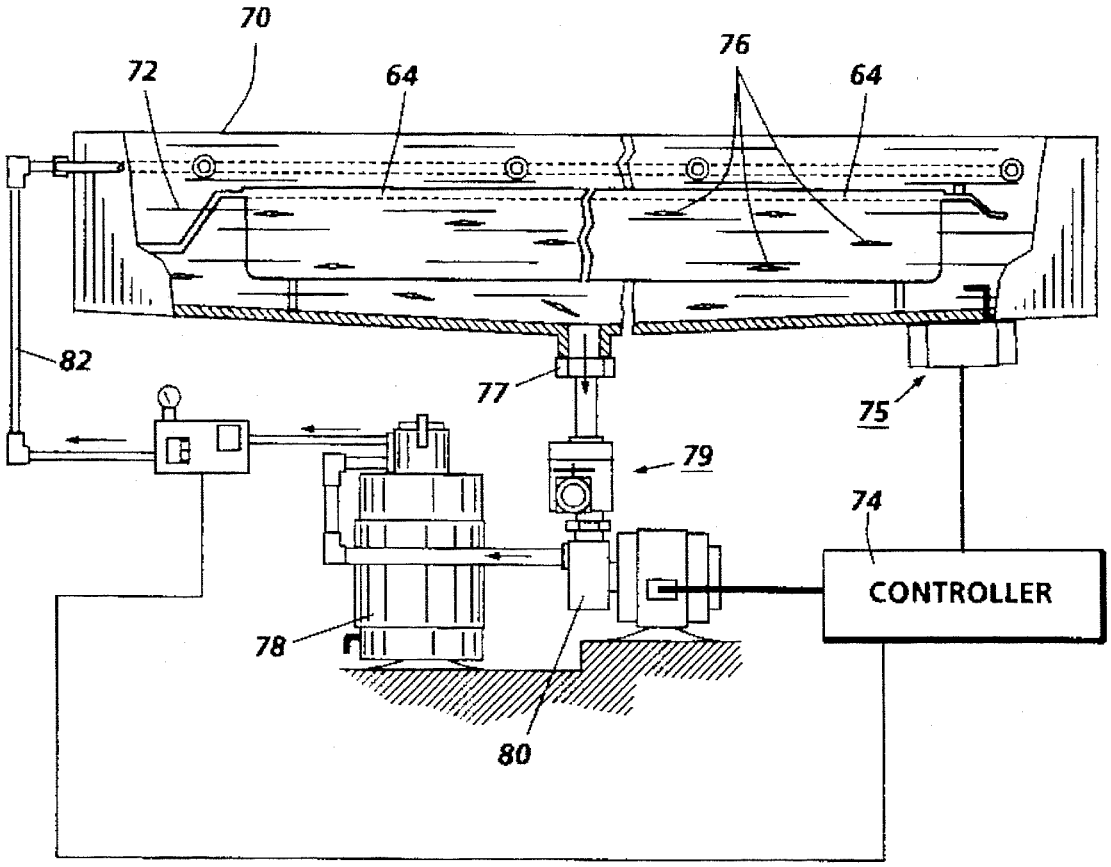
FIG. 6 is a representation of an alkaline ultrasonic cleaning system utilizing cavitation action to remove material as particles.

In FIG. 6 an alkaline ultrasonic cleaning system according to the present invention wherein the bath tank 70 containing the alkaline bath 72 is illustrated. The part to be rejuvenated such as grid 64 is placed in the bath and subjected to ultrasonic cleaning treatment by controlling the ultrasonic frequency and intensity generated by the ultrasonic transducer 75 through the controller 74. After being subjected to the alkaline ultrasonic bath for a sufficient time the flakes 76 of solid particles from the original coating on the part are removed from the bath together with some bath fluid through the drain 77 through value 79 to the filtration system 78 where the solid particles are removed. The alkaline bath fluid 72 is returned to the bath tank 70 by pump 80 through return lines 82.

Thus, according to the present invention a recycled element in the corona generating device together with a method for rejuvenating the device with consequent economical benefit by reduction in the requirement for new parts, at tremendous cost savings together with collection of solid material as a solid which otherwise would have an environmental impact on our culture is provided.

All the patents and the article referred to herein are hereby incorporated by reference in their entirety to the instant specification.

While the invention has been described with reference to the specific embodiments it will be apparent to those skilled in the art that many alternatives, modifications and variations may be made. It is intended to embrace such modifications and alternatives as may fall within the spirit and scope of the appended claims.

I claim:

1. An element in a corona generating device having at least one conductive corona discharge electrode for depositing a negative charge on an imaging surface in an electrostatographic imaging apparatus, said element being capable of adsorbing nitrogen oxide species generated when said corona generating device is energized and capable of desorbing nitrogen oxide species when said corona generating device is not energized, said element having a microetched adhesion promoting surface reclaimed from prior use in a similar capacity by immersion in an alkaline ultrasonic bath where the cavitation action of the bath is sufficient to remove any binder thereon and any metal, metallic compound and other solid particles as solid particles without metallic dissolution in the alkaline bath while at the same time providing a random microetched surface roughness to promote the subsequent coating and adherence of a substantially continuous thin conductive dry film of aluminum hydroxide containing graphite and powdered nickel, said reclaimed element having a substantially thin continuous conductive dry film of aluminum hydroxide containing graphite and powdered nickel conductive corona discharge electrode.

2. The element of claim 1 wherein said film is formed from a liquid dispersion of aluminum hydroxide containing from about 7 to 13 percent by weight graphite and from about 3 percent to about 10 percent by weight nickel by weight of the total weight of the dispersion.

3. The corona generating device of claim 2, further comprising a binder to provide adhesion of said film to said element and cohesion within the matrix of said film.

4. The corona generating device of claim 2, wherein said film is from about 0.3 to about 1.0 mil in thickness.

5. The corona generating device of claim 2, wherein the aluminum hydroxide film exists as the unhydrated oxide, a hydrated oxide, aluminum hydroxide or mixtures thereof.

6. The corona generating device of claim 2, wherein said at least one conductive corona discharge electrode comprises a conductive corona control grid.

7. The corona generating device of claim 2, wherein said element comprises a conductive shield which substantially surrounds said corona discharge electrode and has a longitudinal opening therein to permit ions emitted from the electrode to be directed toward the surface to be charged.

8. The corona generating device of claim 7, wherein said corona discharge electrode comprises a thin wire coated at least in the discharge area with a dielectric material, and said conductive shield has means associated therewith to connect to a potential source.

9. The corona generating device of claim 8, wherein said dielectric material is glass.

10. A method of rejuvenating an element in a corona generating device having at least one conductive corona for discharge electrode depositing a negative charge on an imaging surface in an electrostatographic imaging apparatus which is capable of adsorbing nitrogen oxide species generated when said corona generating device is energized and capable of desorbing nitrogen oxide species when said corona generating device is not energized, said method comprising the steps of:

immersing said element in an alkaline ultrasonic bath where the cavitation action of the bath is sufficient to remove any binder thereon and any metal, metallic compound and other solid particles as solid particles without metallic dissolution in the alkaline bath while at the same time providing a random microetched surface roughness to promote the subsequent coating and adherence of a substantially continuous thin conductive dry film of aluminum hydroxide containing graphite and powdered nickel; and collecting and disposing of said solid particles in an environmentally safe manner and including the step of providing a continuous conductive dry film of aluminum hydroxide containing graphite and powdered nickel on said microetched surface.

11. The method of claim 10 wherein said film is formed from a liquid dispersion of aluminum hydroxide containing from about 7 to 13 percent by weight graphite and from about 3 percent to about 10 percent by weight nickel by weight of the total weight of the dispersion.

12. The method of claim 11, further comprising the step of providing a binder to adhere said film to said element and cohere the matrix of said film.

13. The method of claim 10 wherein said metal, metallic compound and other solid particles which are removed as solid particles by said alkaline ultrasonic bath include nickel and graphite.

14. The method of claim 10, wherein said film of aluminum hydroxide containing graphite and powdered nickel is from about 0.3 to about 1.0 mil in thickness.

15. The method of claim 10, wherein the aluminum hydroxide film exists as the unhydrated oxide, a hydrated oxide, aluminum hydroxide or mixtures thereof.

16. The method of claim 10, wherein said at least one conductive corona discharge electrode comprises a conductive corona control grid.

17. The method of claim 10, wherein said element comprises a conductive shield which substantially surrounds said corona discharge electrode and has a longitudinal opening therein to permit ions emitted from the electrode to be directed toward the surface to be charged.

18. The method of claim 17, wherein said corona discharge electrode comprises a thin wire coated at least in the discharge area with a dielectric material, and said conductive shield has means associated therewith to connect to a potential source.

19. The method of claim 18, wherein said dielectric material is glass.

* * * * *